United States Patent [19]

Dyett et al.

[11] 4,452,172

[45] Jun. 5, 1984

[54] GUMMER FOR CIGARETTE FILTER ATTACHMENT MACHINES

[75] Inventors: Derek H. Dyett; Dennis G. Troll; John K. Horsley, all of High Wycombe, England

[73] Assignee: Molins Limited, London, England

[21] Appl. No.: 389,967

[22] Filed: Jun. 18, 1982

Related U.S. Application Data

[63] Continuation of Ser. No. 215,338, Dec. 11, 1980, abandoned.

[30] Foreign Application Priority Data

Dec. 11, 1979 [GB] United Kingdom ..... 7942571

[51] Int. Cl.[3] ..... B05C 1/08

[52] U.S. Cl. ..... 118/203; 118/259; 118/262

[58] Field of Search ..... 118/259, 203, 246, 247, 118/248, 262, 70; 401/218, 219, 220; 101/363

[56] References Cited

U.S. PATENT DOCUMENTS

| | | | |
|---|---|---|---|
| 2,125,336 | 8/1938 | Ettl | 118/226 X |
| 2,731,945 | 1/1956 | Schaefer | 118/262 X |
| 2,871,500 | 2/1959 | Hunn et al. | 401/218 X |
| 3,097,968 | 7/1963 | Schaefer | 118/259 |
| 3,146,159 | 8/1964 | Muggleton | 118/262 |
| 3,162,545 | 12/1964 | Dearsley | 118/203 |
| 3,511,693 | 5/1970 | Davidson | 118/259 |
| 4,089,294 | 5/1978 | Lasiewicz et al. | 118/262 X |
| 4,138,965 | 2/1979 | Riese et al. | 118/203 |
| 4,237,816 | 12/1980 | Shimono et al. | 118/259 X |

*Primary Examiner*—John P. McIntosh

*Attorney, Agent, or Firm*—Antonelli, Terry & Wands

[57] ABSTRACT

A gummer for a filter attachment machine comprises two rollers (10, 12), one of which is arranged to contact the web and the other of which is pressed against the first roller to limit the quantity of gum which is transmitted to the web from a pool of gum formed in the nip between the rollers. Gum is fed continuously into the pool at a position between the ends of the rollers at a rate in excess of the rate at which gum is applied to the web, from which position the gum flows towards the ends of the rollers. Means (15, 16, 50) are provided for collecting excess gum at the ends of the rollers and for returning it to a source (19) of the gum.

14 Claims, 8 Drawing Figures

Fig. 1.
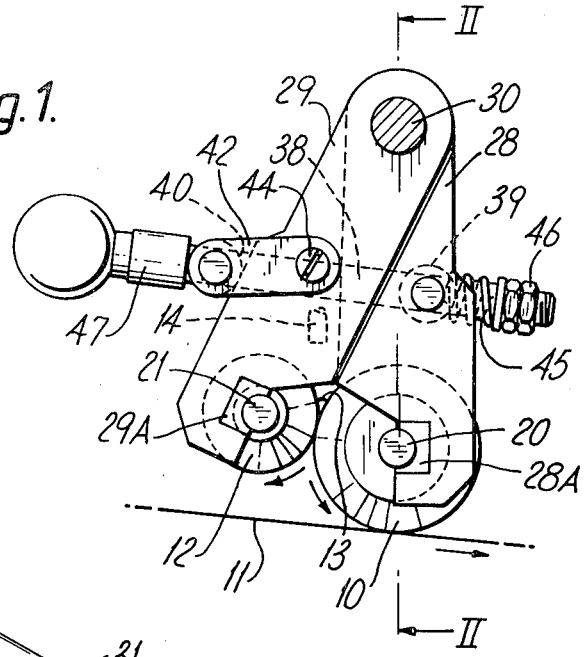
Fig. 3.
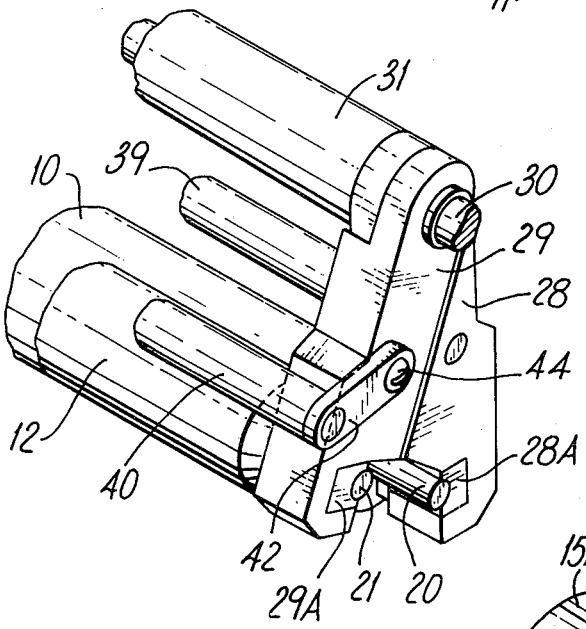
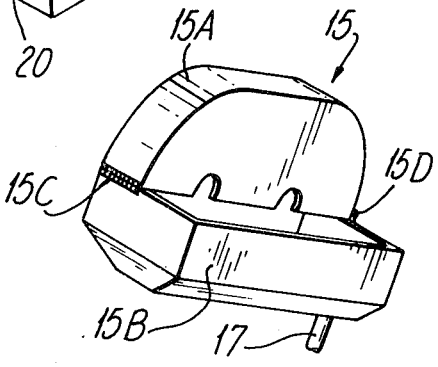
Fig. 4.

GUMMER FOR CIGARETTE FILTER ATTACHMENT MACHINES

This is a continuation of Application Ser. No. 215,338 filed Dec. 11, 1980, now abandoned.

This invention is concerned with a gummer for applying a film of adhesive to a moving web. It is particularly concerned with gumming the web of uniting material used in a filter attachment machine in which tobacco rods and filters are joined by an encircling portion of the web.

One form of gummer which has been used in a filter attachment machine (the Molins PA8 machine) is described in British Pat. Specification No. 919740. One problem with that form of gummer is that each of the two rollers needs to form a running seal in cooperation with one of the edges of the housing which, together with the rollers, defines a chamber containing gum. Another form of gummer which has been used involves a roller which dips into a bath of gum to pick up a film of gum which is then transferred to a further roller engaging the web; that gummer avoids the sealing problem but has other significant problems.

In this context the term "gum" is intended to include any type of liquid adhesive including, in particular, polyvinyl acetate.

A gummer according to the present invention comprises a roller, means for forming a pool of gum along and adjacent to the roller, from which pool the roller is arranged to carry a film of gum for transfer to a moving web, characterised in that the means for forming the pool of gum comprises means for delivering gum continuously into the pool, at a position between the ends of the roller, at a rate in excess of the rate at which the roller is arranged to carry gum from the pool, the pool being formed as a stream flowing from the delivery position towards the ends of the roller, and including means for collecting excess gum from the ends of the roller and for returning it to a source of the gum.

There is preferably a second roller which is horizontally spaced from the first roller and runs in contact with the first roller, the pool of gum being formed in the nip between the two rollers. Alternatively, instead of the second roller there may be simply a fixed scraper.

One advantage of this gummer is that it has only a small volume of gum in the pool, thus minimising degradation which is caused to some gums by excessive working. Another advantage is that, in the preferred arrangement with two rollers, the rollers are horizontally spaced (though not necessarily at exactly the same level) and the pool or stream of gum is contained in the nip of the rollers by gravity, thus avoiding any problem of sealing; there is no need to have any cover over the pool of gum, though a cover may be included.

According to another aspect of this invention a gummer comprises two rollers, one of which is arranged to contact a moving web which is to receive a film of gum, and the other of which is pressed against the first roller to limit the quantity of gum which is transmitted to the web from a pool adjacent to the first roller, characterised in that the pool of gum is a stream formed along at least one of the rollers by gum supplied continuously to a position between the ends of the rollers at a rate in excess of the rate at which gum is applied to the web, from which position the gum flows towards the ends of the rollers, and including means for collecting excess gum at the ends of the rollers and for returning the excess to a source of the gum.

Examples of gummers according to this invention are shown in the accompanying drawings. In these drawings:

FIG. 1 is an end elevation of one gummer with parts removed for the sake of clarity;

FIG. 3 is a diagrammatic perspective view of one end of the gummer of FIG. 1, but with the gum-receiving housings removed;

FIG. 4 is a diagrammatic perspective view of the gum-receiving housing for the end of the gummer shown in FIG. 3;

Figure 2:
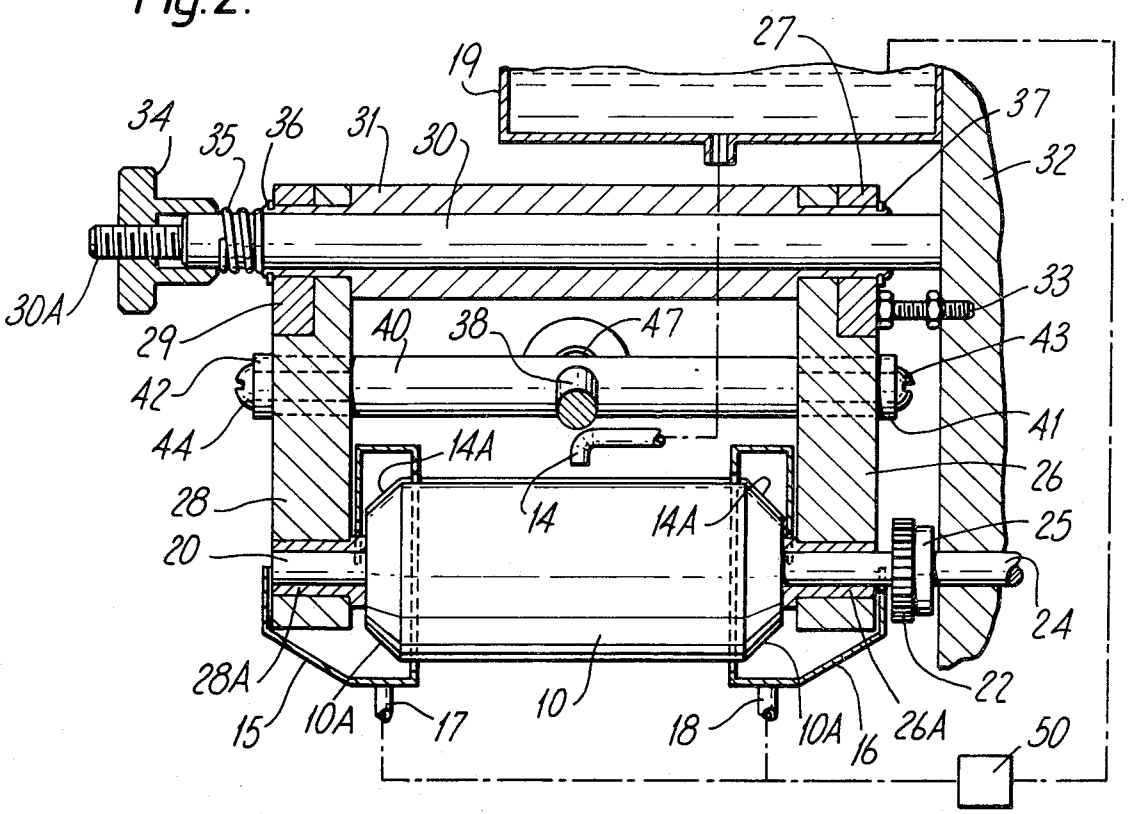
FIG. 2 is a section of the entire gummer assembly on the line II—II in FIG. 1.

The gummer shown in FIG. 1 includes an applicator roller 10 arranged to contact the upper surface of a web 11 to which the roller 10 applies a film of gum. A second roller 12 is pressed against the roller 10 (as described below) so that a controlled film of gum is carried in a counter-clockwise direction by the roller 10 from a moving pool (stream) of gum 13 lying in the nip between the rollers. The rollers 10 and 12 are parallel and are horizontally spaced, so that the pool of gum remains in position under gravity.

Gum is delivered to the pool through a pipe 14 midway between the ends of the rollers at a rate slightly in excess of the rate at which gum is applied to the web 13. Thus the gum in the pool 13 flows towards the ends of the rollers, and excess gum which is not transferred to the web is flung off the ends of the rollers into housings 15 and 16 (FIG. 2) which have bottom outlets 17 and 18 from which the gum is returned by a pump 50 to the source of gum. The source of gum is a reservoir 19 lying above the gummer. Gum passes from the reservoir through the pipe 14 under gravity; it may alternatively be delivered via a positive-displacement pump, e.g. a peristaltic pump.

Figure 5:
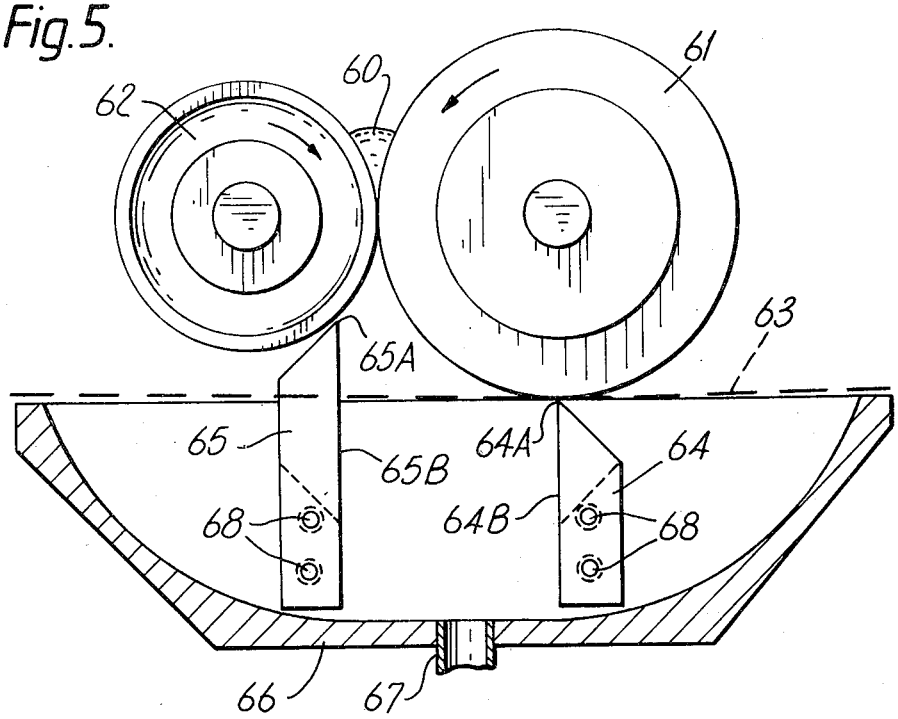
FIG. 5 is a front view of a different gummer with parts omitted.
Figure 6:
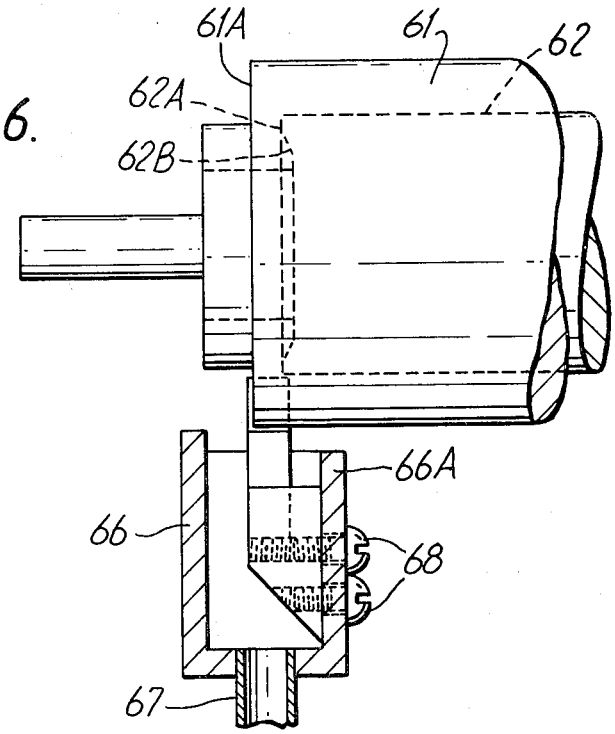
FIG. 6 is a view from the right of FIG. 5 showing only one end of the gummer rollers.

Each of the rollers 10 and 12 has chamfered ends 10A and 12A as a result of which the excess gum is flung centrifugally off the rollers from approximately the corner formed by the chamfered and main cylindrical surfaces of each roller. This results in a particularly reliable and clean-running device, and ensures that gum does not reach the center shafts 20 and 21 on which the rollers are mounted. However, as an alternative, other means may be provided for returning the excess gum from the ends of the rollers to the source: for example, suction pipes may be arranged to extend into the nip area between the rollers at each end of the rollers; another example is shown in FIGS. 5 and 6.

The rollers 10 and 12 are driven with the same peripheral speed via intermeshing gears 22 on the shafts 20 and 21. Only one of these gears (on the shaft 20) is shown; it will be understood that the gear on the shaft 21 is slightly larger. The gear on the shaft 20 receives the drive for the gummer via an input shaft 24 which has a flange 25 carrying a pin engaging in a hole in the gear 22 whereby the roller 12 is driven and is timed with respect to the web cutting device (not shown). This is in order to apply a timed pattern of gum to the web 11; for example, the roller 12 may have slightly raised cylindrical areas which mate closely with the roller 10 so as to squeeze out all gum in those areas, a thin film of gum being applied to the web 11 only over the slightly-recessed remaining areas. Any desired pattern of gum may be applied in this way.

In order to clamp the rollers together with a predetermined force, the following mounting arrangement for the rollers is provided. At the ends of the rollers there are two pairs of arms 26, 27 and 28, 29 pivoted together on a mounting pin 30 surrounded by a spacer sleeve 31, as shown in FIG. 2. The mounting pin projects from the face of a machine casting 32 which also carries an adjustable set screw 33 determining the operative position of the gummer along the mounting pin. The gummer can be removed by removing a nut 34 from a threaded end 30A of the mounting pin, after which the entire gummer can be slid off the mounting pin. A spring 35 between the nut and the adjacent end of the sleeve 31 normally (while the gummer is in use) presses the gummer against the set screw 33. Circlips 36 and 37 in the sleeve 31 hold the brackets in position on the sleeve.

Each of the arms has a half bearing 26A, 27A, 28A or 29A near its lower end which engages one of the shafts. The arrangement at one end of the gummer is shown in FIG. 3, the other end being similar.

The pairs of arms carrying the respective rollers are resiliently urged together by means of an over-center toggle device which is as follows. A spindle 38 passes through a pin 39 which has its ends rotatably mounted in the arms 26 and 28 engaging the roller 10; it also passes through a rotatable pin 40 mounted on the ends of two links 41 and 42 which, at their other ends, are pivoted connected by screws 43 and 44 to the arms 27 and 29 engaging the roller 12. There is a compression spring 45 between the pin 39 and a nut 46 on the adjacent end of the spindle; and a head 47 engages the pin 40. Thus the rollers are urged together through the force produced by the spring. When the spindle 38 is rotated in a clockwise direction about the pin 39, from the over-center position shown in FIG. 1, to beyond a position at which the centers of the pins 39 and 40 and the screws 43 and 44 are aligned, the spring pushes the rollers apart, thus allowing the rollers to be removed from the half bearings in the arm, e.g. for cleaning.

In the "locked" position the pin 40 engages the arms 27 and 29 (see FIG. 1). This limits rotation of the links 41, 42 with respect to the arms 27, 29 in a counter-clockwise direction.

There may be an additional locating pin on the machine casting 32 to engage in a hole in one of the arms or on a part secured to one of the arms.

As shown in FIG. 4, each of the housings is formed in two parts, for example 15A and 15B, pivoted by a hinge 15C at one end and releasably secured at the other end by a fastener 15D. It should be understood that the housings are removed from the rollers before the rollers are released by rotation of the toggle device.

A solenoid valve may be included in the pipe line 14 whereby the supply of gum can be switched off as soon as the machine stops.

When the machine stops, there may be provision for automatically feeding water to the rollers through the pipe line 14 (or through a separate pipe) to clean the rollers by removing the gum. The dirty water may be delivered by the pump 50 to a special refuse container.

There may be provision for heating the gum on its way through the pipe 14, especially while the machine is running at full speed.

The two housings may be joined together; e.g. may comprise a top part which extends over both rollers, and a lower part which can be swung downwards to allow the web to be easily threaded into position, the web being arranged to pass through slots in the housing defined between the upper and lower parts of the housing. The lower part of the housing may be machined to provide channels through which the excess gum from both ends of rollers passes to a single outlet in place of the dual outlets 17 and 18.

The main advantage obtained by chamfering the ends of the rollers is as follows. Any adhesive which is flung upwards by centrifugal force and then drips downwards from the roof of the housing and onto the roller is assured of being flung outwards again, i.e. has substantially no chance of reaching the shaft.

FIGS. 5 and 6 show parts of a different gummer. As in the previous example, a stream of gum 60 flows between two rollers 61 and 62 of which the roller 61 is arranged to transfer a film of gum to a moving web 63. However, in this example, substantially all the excess gum is removed from the ends of the rollers by fixed plough members 64 and 65. Sharp upper edges 64A and 65A of these members lie close to, but not actually in contact with, the ends of the rollers 61 and 62; thus the excess gum runs down faces 64B and 65B into a trough-shaped member 66 forming the lower part of an enclosure around the corresponding end of the rollers, the upper part of the enclosure being omitted from FIG. 5 for the sake of clarity. Excess gum is pumped away, back to a reservoir (not shown), via a pipe 67.

FIG. 6 shows only one end of the rollers. At the other end of the rollers there is a similar arrangement including plough members for removing excess gum.

As shown particularly in FIG. 6, each of the plough members 64 and 65 is secured to one side wall 66A of the trough member 66 by two screws 68. As an alternative, the plough members may be mounted on bars secured to members carrying the rollers, for example pivoted arms 28 and 29 as shown in FIGS. 1 to 3.

As shown in FIG. 6, the rollers 61 and 62 in this example have flat end faces 61A and 62A respectively. Moreover, the roller 61 which applies adhesive to the web is longer than the roller 62. Finally the roller 62 has a recess 62B in a central region of its end face. The arrangement at the other end of the rollers 61 and 62 is the same.

Figure 7:
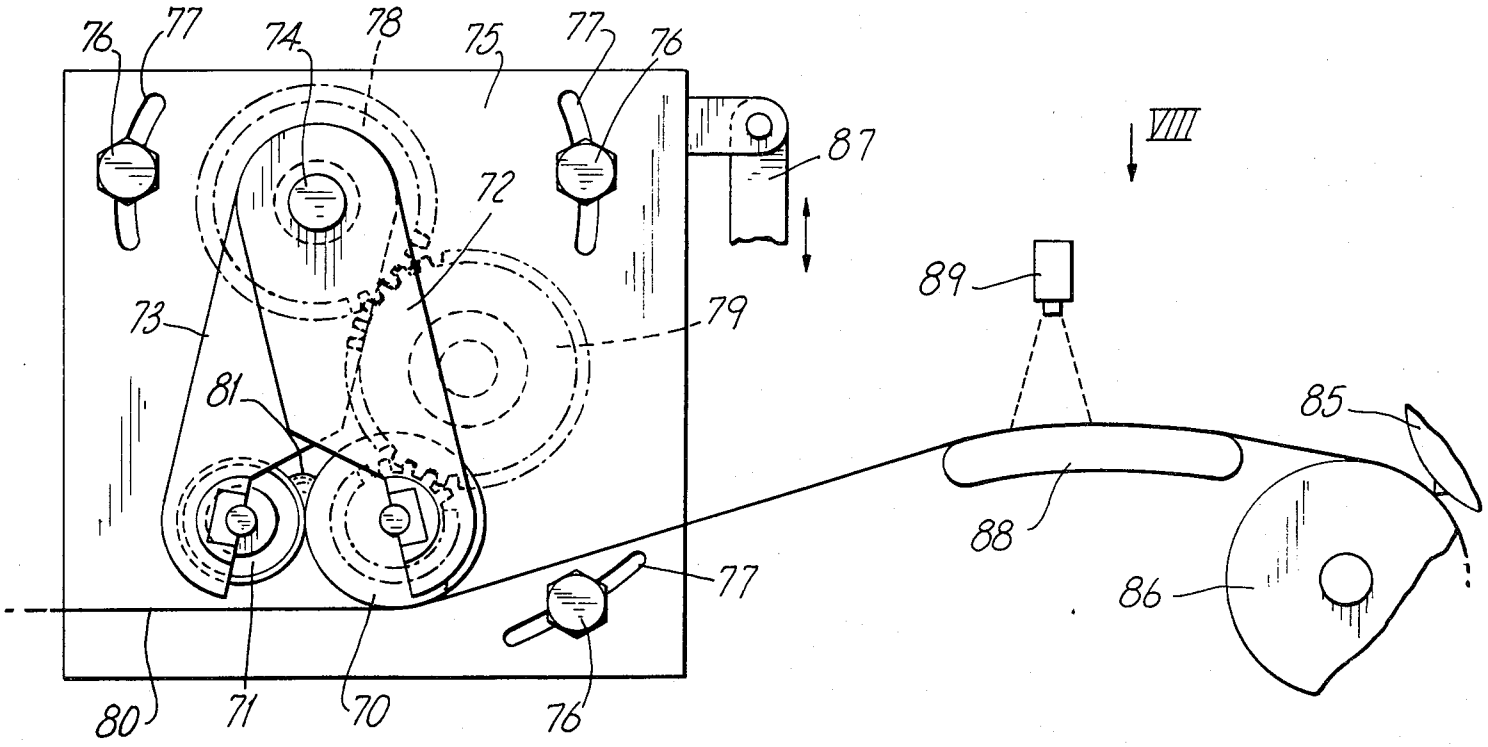
FIG. 7 is a diagrammatic view of a different gummer.
Figure 8:
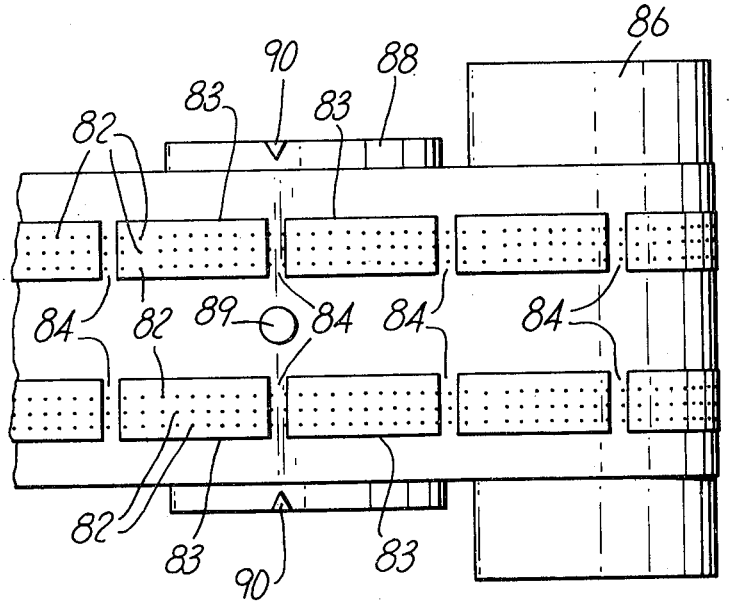
FIG. 8 is a view in the direction of the arrow VIII in FIG. 7.

FIGS. 7 and 8 show a different example. In this example, the gummer is substantially the same as that shown in FIGS. 1 to 4. It includes rollers 70 and 71 which are carried at each end by arms 72 and 73 pivotally mounted on a post 74. The arms are urged together by a spring (not shown) to press the rollers together.

The entire gummer assembly is mounted on a plate 75 which in turn is retained on the frame of the filter assembly machine (not shown) by a number of bolts 76 passing through arcuate slots 77 which are curved about the axis of an input gear 78 which is rotatable in a bearing in the machine frame. The rollers are driven at the appropriate speeds via an intermediate gear 79 which is rotatably mounted on the rear face of the plate 75 and meshes with the input gear 78 and with a gear attached to the roller 70; this last gear may mesh with a gear attached to the roller 71, as in FIG. 1, though the roller 71 may alternatively be driven frictionally by contact with the roller 70. Thus the angular position of the plate about the axis of the gear 78 can be adjusted while keeping the intermediate gear 79 in mesh with the gear 78.

Angular adjustment of the plate 75 is provided for the following reason. The surface of the roller 70 is recessed by a small fraction of a millimeter in areas where it is required to carry adhesive for transferring to the web 80. Where no adhesive is to be applied to the web, the surface of the roller tightly engages the roller 71 so that adhesive is squeezed away, i.e. remains in the stream 81 contained in the nip between the two rollers. In particular, it may be required that no adhesive is applied over selected areas over which the web 80 is perforated in order to produce ventilated cigarettes. FIG. 8 shows two longitudinally perforated areas in each of which there are three rows of perforations 82, it being understood that the web is used to join two cigarette portions to a double-length filter portion to form an assembly which is finally cut through the middle to form two individual ventilated filter cigarettes.

The roller 70 in this particular example is machined so that no adhesive is applied over two groups of longitudinally spaced areas 83 in the region of the perforations. Between those areas 83 there are intermediate areas 84 to which adhesive must be applied in order to stick down completely the edges of each portion of the web which ultimately joins a cigarette portion to a filter. The web 80 is in fact cut transversely midway through the areas 84 by means of a cutting head 85 (FIG. 7) cooperating with a drum 86, which may be the rolling drum by which filter assembly is achieved as in the Molins PA8 filter attachment machine.

If the timing of the ungummed areas 83 is incorrect, so that the transverse cuts are not made substantially midway between the areas 84 then faulty cigarettes may be produced. Adjustment of that timing can be effected by rotating the plate 75 slightly about the axis of the gear 78. For that purpose, an adjustment member 87 is provided. This may be in the form of a screw which is manually adjusted upwards and downwards by rotating an anchored nut (not shown), or it may be controlled by a servo device which may respond automatically to an automatic detection system.

In order to allow easy determination of the position of the dry patches 83 while the machine is running, the following provision is made. As it approaches the drum 86, the web 80 passes over a fixed guide 88 which may be heated. Above the guide 88 there is a light emitting device 89 which is arranged to emit a pulsed beam of light downwards on to the web, the pulses being at the frequency at which successive dry patches 83 pass beneath the device 89. The timing of the pulses is such that, if the dry patches 83 are in their correct positions, they will appear to a viewer, owing to the stroboscopic effect, to be stationary over the guide 88 at positions such that two marks 90 on the guide lie on a line passing through the middle of one of the areas 84. If the areas 84 appear to have moved relative to that line then the plate 75 carrying the gummer is rotated slightly in the appropriate direction to restore the proper timing of the areas 83.

Alternatively the arrangement may be such that the marks 90 are required to line up with the leading ends of areas 84, or with the trailing ends.

A pulsed electrical signal for the light emitting device 89 may be obtained in any convenient way. For example, it is common to generate a pulse corresponding to the cigarette flow rate to serve as a timing pulse whereby various timing operations and faulty cigarette ejection operations can be achieved. The same timing pulse can be used to produce appropriate light pulses from the device 89.

In practice, the gummer may be some distance from the drum 86 at which the web is cut. Moreover, the tension in the web 80 and the stretchability of the web may vary slightly from time to time. It is for that reason that it is useful to have the dry patch monitoring feature and the provision for adjusting the timing of the dry patches as described above. This monitoring feature may in principle be used with other forms of gummer.

In order to determine exactly the position of the roller 70 relative to the plate 75, there may be a locating pin on the plate (not shown) which engages in an aperture in the arm 70 supporting the adjacent end of the roller 70.

In FIG. 7 the input gear 78 is shown coaxial with the post 74, but it need not be so.

We claim:

1. A gummer comprising a roller, means for forming a pool of gum along and adjacent to the roller, from which pool the roller is arranged to carry a film of gum for transfer to a moving web, characterized in that the means for forming the pool of gum comprises means for delivering gum continuously into the pool, at a position between the ends of the roller, at a rate in excess of the rate at which the roller is arranged to carry gum from the pool, the pool being formed as a stream flowing from the delivery position towards the ends of the roller, and including means for collecting excess gum from each end of the roller and for returning it to a source of the gum, said gum collecting means at each end of the roller being arranged to allow gum to flow substantially without restriction to the extremity of the peripheral surface of the roller and to continue as an unconfined bead of excess gum extending around part of the periphery of the roller at the said extremity, and said gum collecting means including means for guiding the said bead of gum downwardly from the roller.

2. A gummer according to claim 1 in which the roller is arranged to transfer the film of gum directly to a moving web running in contact with the roller.

3. A gummer according to claim 1 including a second roller which is horizontally spaced from the first roller and runs in contact with the first roller, the pool of gum being formed in the nip between the two rollers, said second roller having gum collecting means similar to the gum collecting means of the firstmentioned roller.

4. A gummer according to claim 3, including means for urging the rollers firmly into contact with one another.

5. A gummer according to claim 3 in which the two rollers are carried respectively by two pairs of arms which are both pivotally mounted on a common mounting pin.

6. A gummer according to claim 5, including means for urging the rollers together comprising a spring arranged to urge the two pairs of arms towards one another about the mounting pin.

7. A gummer according to claim 5 or claim 6, in which each roller has a central shaft which is carried at each end by a half bearing member in the corresponding arm from which it can be readily released once the means urging the arms together are disengaged.

8. A gummer according to claim 1, in which said means for guiding the gum from the roller comprises, at each end of the roller, a fixed plough member confined to the region of the end of the roller and lying in close proximity to the periphery of the roller for guiding the bead of adhesive downwards from the roller.

9. A gummer according to claim 8 in which the plough member has an edge which slightly placed from the roller and is substantially parallel to the axis of the roller and to a portion of the periphery of the roller with which the said edge partly overlaps.

10. A gummer according to claim 1, wherein said means for guiding said bead of gum downwardly from the roller extends to a position close to said roller.

11. A gummer comprising two rollers, one of which is arranged to contact a moving web which is to receive a film of gum, and the other of which is pressed against the first roller to limit the quantity of gum which is transmitted to the web from a pool adjacent to the first roller; means for forming said pool of gum as a stream extending along at least one of the rollers by supplying gum continuously to a position between the ends of the rollers at a rate in excess of the rate at which gum is applied to the web, from which position the gum flows towards the ends of the rollers; means for collecting excess gum at the ends of the rollers and for returning the excess gum to a source of the gum, said collecting means being adapted to allow the excess gum to flow substantially without restriction to both ends of both rollers and around at least part of the periphery of each end; and means for guiding excess gum discharged from both ends of both rollers to said collecting means with the aid of centrifugal force.

12. A gummer comprising two rollers, one of which is arranged to contact a moving web which is to receive a film of gum, and the other of which is pressed against the first roller to limit the quantity of gum which is transmitted to the web from a pool adjacent to the first roller, characterized in that the pool of gum is a stream formed along at least one of the rollers by gum supplied continuously to a position between the ends of the rollers at a rate in excess of the rate at which gum is applied to the web, from which position the gum flows towards the ends of the rollers, and including means for collecting excess gum at the ends of the rollers and for returning the excess to a source of the gum, said collecting means being positioned to allow the gum to flow substantially without restriction to the peripheral extremities at both ends of both rollers, at least one of the rollers having chamfered ends whereby excess gum is flung off centrifugally from the edge defined by the chamfered surface and the adjacent cylindrical surface of the roller.

13. A gummer comprising two rollers, each being supported at its ends by two arms; means for pivoting all four arms about a common axis parallel to the axes of both rollers; and spring means for urging the arms supporting each roller towards the arms of the other roller whereby the rollers are resiliently pressed together; support means including a hollow bush coaxial with said common axis for effecting pivotal support of the arms and adapted to be releasably mounted on a mounting pin arranged to carry the entire gummer assembly, and including means for feeding gum into the nip between the two rollers in order to produce a film of gum on one of the rollers for transfer to a web moving in contact therewith, and means for collecting excess gum from the ends of the roller and for returning the excess to a source of the gum.

14. A gummer comprising two parallel contiguous rollers, means for forming a pool of gum adjacent to at least one of the rollers whereby a film of gum is conveyed from the pool by one of the rollers for application to a moving web, two pairs of arms arranged respectively to carry the two rollers and being pivotally supported on fixed support means at ends of the arms remote from the rollers, and means for urging the pairs of arms together to ensure firm contact between the rollers, each arm having a half bearing member arranged to engage a central shaft associated with a corresponding one of the rollers, whereby the rollers can be readily released from the arms upon disengagement of the urging means.

* * * * *